United States Patent [19]

Nizel et al.

[11] Patent Number: 4,544,214

[45] Date of Patent: Oct. 1, 1985

[54] LABORATORY FURNITURE SYSTEM

[75] Inventors: Robert N. Nizel, Carlisle, Mass.; Frank D. Schimmoller, Westwood, N.J.

[73] Assignee: Architectural Resources Cambridge, Inc., Cambridge, Mass.

[21] Appl. No.: 450,004

[22] Filed: Dec. 15, 1982

[51] Int. Cl.[4] ..... B01L 19/02

[52] U.S. Cl. ..... 312/209; 312/223; 312/228

[58] Field of Search ..... 248/157, 161, 235; 52/28, 36, 220, 221; 108/64; 211/187, 193, 207, 175, 190; 312/209, 203, 198, 223, 228

[56] References Cited

U.S. PATENT DOCUMENTS

| | | | |
|---|---|---|---|
| 1,369,902 | 3/1921 | Miller et al. | 312/228 X |
| 1,435,015 | 11/1922 | Lidberg | 312/209 |
| 2,020,503 | 4/1933 | Hanson et al. | 248/188.5 |
| 3,085,839 | 4/1963 | Gallagher | 312/223 |
| 3,170,742 | 2/1965 | Berkowitz | 108/64 |
| 3,404,884 | 10/1968 | Sorenson et al. | 248/157 X |
| 3,443,348 | 5/1969 | Papayoti . | |
| 3,468,567 | 9/1969 | Attwood et al. . | |
| 3,601,347 | 9/1969 | Attwood et al. . | |
| 3,617,076 | 11/1971 | Attwood et al. . | |
| 3,618,882 | 11/1971 | Podedworny . | |
| 3,628,296 | 12/1971 | Henry . | |
| 3,920,299 | 11/1975 | Propst et al. | 312/323 |
| 4,050,752 | 9/1977 | Dykstra | 312/243 |
| 4,190,377 | 2/1980 | Pluess . | |
| 4,379,430 | 4/1983 | Ruschitza | 211/190 |
| 4,433,884 | 2/1984 | Edwards et al. | 312/209 |

FOREIGN PATENT DOCUMENTS

| | | |
|---|---|---|
| 1598805 | 2/1971 | Fed. Rep. of Germany . |
| 2413889 | 9/1975 | Fed. Rep. of Germany . |
| 1389537 | 1/1965 | France . |

*Primary Examiner*—William E. Lyddane
*Assistant Examiner*—Joseph Falk
*Attorney, Agent, or Firm*—Mandeville & Schweitzer

[57] ABSTRACT

Disclosed herein is a new and improved laboratory furniture system including a free-standing, universal laboratory utility core module adapted to cooperate with one or more modular, adjustable C-frame laboratory bench supports, modular laboratory hood units, modular laboratory sink units, and like modular laboratory units to provide a fully serviced laboratory work center and/or equipment station. The utility core module comprises two pairs of spaced parallel vertical corner columns of predetermined modular height; two pairs of spaced reinforcing struts extending laterally between and connecting uppermost and lowermost portions of said pairs of columns; two pairs of spaced parallel horizontal beams connecting said two pairs of columns at the tops and bottoms thereof to form a parallelpiped service frame; a rectangular, planar top shelf means supported by the upper horizontal beams and closing off the top of said service frame; a full depth, central rectangular shelf means disposed beneath said top shelf means in a plane parallel to the plane of said top shelf means and supported by said corner columns; and a tunnel means of inverted-U shape cross-section supported beneath said central shelf means at any desired or necessary elevation above the lower horizontal beams.

The new laboratory furniture system is designed to be fully integrated with and to include support for and concealment of laboratory gas supply lines, plumbing lines such as acid vents and drains, electrical cables, special ventilating systems for heavier than air fumes, and other service lines required in the conduct of the entire spectrum of clinical laboratory tests.

8 Claims, 16 Drawing Figures

CEILING
8
9
15
16
10
14
14
COLUMN 34
33
14
81
33
14
82

94
61
93
94
61
36
76
36
77
77
30
15
40
69
50
115
61
15
120
122
121
14
83
83
78
13
11
FLOOR
12

LABORATORY FURNITURE SYSTEM

BACKGROUND AND SUMMARY OF THE INVENTION

With the rapid evolution of sophisticated clinical laboratory testing procedures for large scale and high volume diagnostic analyses of patient specimens involving highly automated equipment often utilizing computerized data bases and computerized controls, there has arisen a concommitant need for sophisticated, flexible physical structures to house and to support test equipment, test supplies and the like in efficient test stations which can be specially arranged and rearranged when necessary.

Heretofore laboratories have often been established on a permanent basis at substantial cost, to provide in each area of the laboratory, particular testing services or to provide a corollary support function. These earlier laboratories and laboratory units and/or laboratory sub-units have employed laboratory furniture in the nature of standardized laboratory benches, fume hoods, sinks, rolling tables and associated cabinetry, much of which has been modular in form. While many of these laboratory modules have been well suited for installation in permanent laboratory complexes, there has been a need for new and improved laboratory structures, including laboratory furniture which can be selectively and readily connected and disconnected to necessary utility services such as water lines, gas lines, air lines, suction lines, and related plumbing services, as well as being selectively and readily connected and disconnected from electrical and electronic services, including power lines, telephone lines, computer cables and the like.

It is to the provision of new and improved laboratory structures, especially well adapted for the conduct of clinical laboratory testing services on a very large scale basis, that the present invention is directed. Specifically, in accordance with the broad and fundamental concepts of the invention the new system is adapted for use in a laboratory building which is provided with built-in regular grids of plumbing, electrical, and auxiliary laboratory services disposed in and above the laboratory ceilings and the laboratory floors, although such grids are not a prerequisite to the use of the system. These services are readily accessible at regular and predetermined locations within all areas of the laboratory and through the regularly spaced structural columns of the laboratory building.

In accordance with the principles of the present invention, individual laboratory stations are established by the combination of one or more of a series of adjustable, flexible laboratory furniture modules, the basic and major common component of each of which stations is one or more vertical, utility module frames. The new and improved utility modules themselves may be free standing or connected to one another in end-to-end series for association with a building wall, ceiling, floor, and/or column through which direct connection is made to the grid of electrical and plumbing services. In addition, connection may be made to the grid of waste lines in the floor. The utility modules are dimensionally standarized in height and width so as to be readily compatible with new and improved bench modules mounted on C-frames and having adjustable heights. These bench modules have a variety of integral sinks, and are adapted to mount fume hoods and like laboratory accessories. The utility modules are adapted to support, at adjustable elevations, standardized shelves and/or modular drawers and/or modular cabinetry in association with the adjustable C-frame sinks and C-frame benches to establish complete and independent work stations.

As a specific and unique aspect of the invention, the utility modules include shelves disposed above the working surfaces of the associated C-frames, which shelves themselves comprise, in part, raceways or conduits for electrical services, support for individual lighting fixtures and/or concealed support for gas vent plumbing.

A further specific and unique aspect of the new and improved utility module provides for the inclusion therein of an inverted U-shaped tunnel structure, the height of which may be adjusted to correspond with the height of associated C-frame benches or C-frame sinks in a manner whereby the upper surface of the tunnel, which functions as a shelf or work surface, may be flush with or spaced above the working surface of an associated laboratory bench, rolling table or sink; the upper surface of the tunnel may itself be provided with a small sink, i.e. a cup sink, and an appropriate plumbing fixture such as a water spigot; or the upper surface of the tunnel may be provided with appropriate fixtures to supply plumbed-in water (hot or cold) special gases (oxygen, nitrogen, etc.), air under pressure or a vacuum to the work station being established.

In accordance with the invention, these laboratory modules may be arranged in any permutation, with infinitely adjustable work surface heights, into individual groups for establishing work stations for performance of individual laboratory testing services as needed and in whatever relationships may be necessary or desirable to nearby or contiguous stations. Thus, if a particular testing station's function is obsoleted, is changed or if it is otherwise desired to change its relationship to another station or to modify its particular function; or if it were desired to increase or to decrease the capacity of a particular station, the ready interchangeability and the flexibility of the new and improved multi-functional modules, in combination with the requisite laboratory services which may be disposed at regular and predetermined patterns of access in the laboratory walls, columns, ceilings, and floors makes such change comparatively expeditious and inexpensive to perform.

For a more complete appreciation of the new and improved laboratory furniture system of the present invention, reference should be made to the following detailed description of the invention taken in conjunction with the accompanying drawings.

DETAILED DESCRIPTION OF THE INVENTION

Disclosed hereinafter is a new and improved furniture system for a laboratory which is capable readily, easily and without undue expense of being flexibly arranged as a high volume factory for efficiently handling large numbers of specimens on a continuous basis for testing or any other desired laboratory use.

Figures 8, 8A:
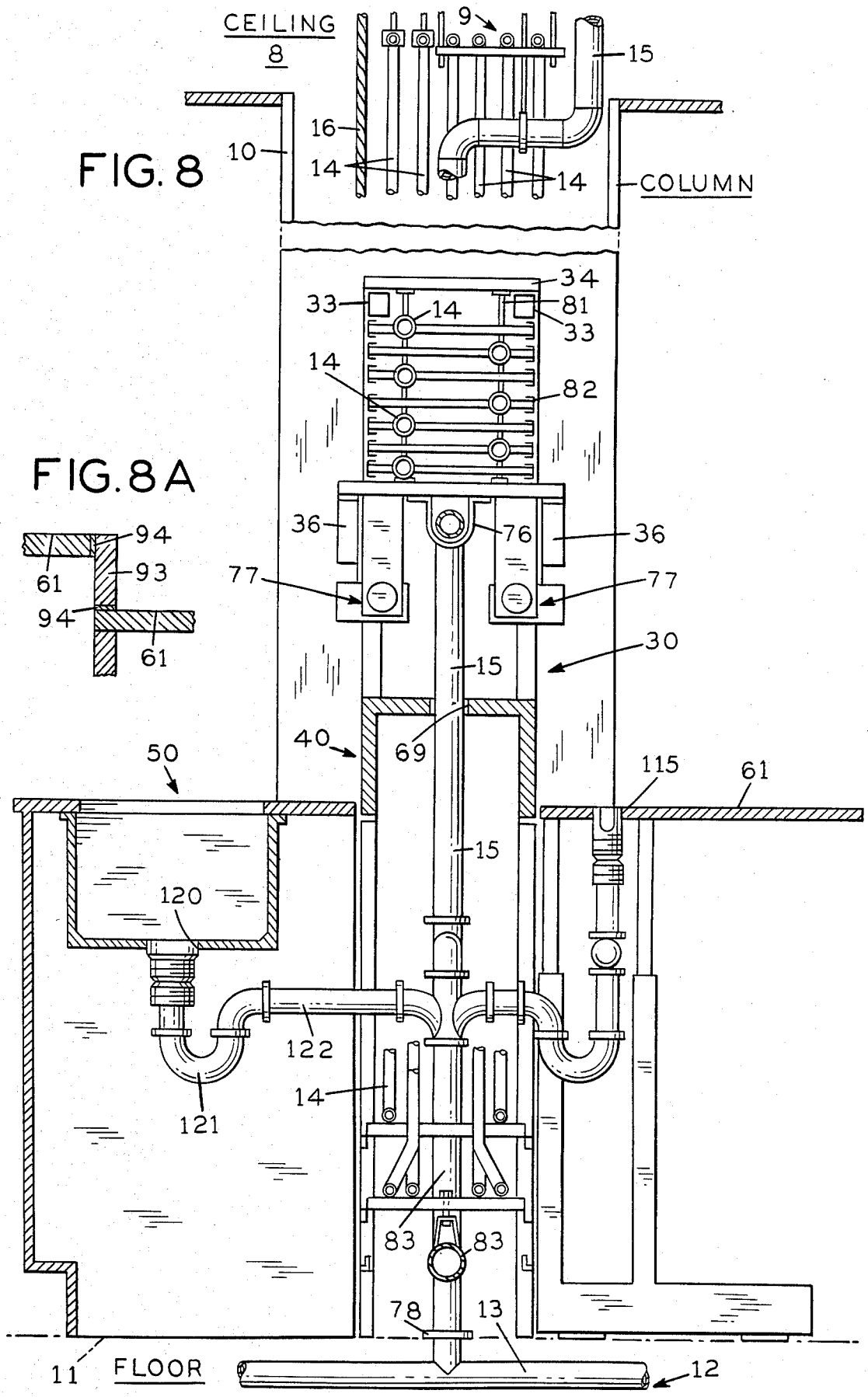
FIG. 8 is an enlarged cross-sectional view of the new and improved central utility module illustrating the manner in which utility services are delivered to the work stations created with the new laboratory furniture.
FIG. 8A is a detail of bench top construction.

Referring initially to FIG. 8, the overall laboratory building, hospital, or like structure in which the new and improved laboratory furniture of the present invention is adapted to be flexibly installed includes, in its interstitial space, grids or other regular patterns of electrical and utility services 9 disposed in the ceilings 8 or floors 11 and descending and/or rising at regular intervals throughout the structure at regularly spaced building service points, e.g. columns 10. The floors 11 of the structure into which the present modular furniture is adapted to be installed include a regular and systematic pattern of grids 12 of waste lines 13 for attachment to the laboratory furniture sink modules wherever required. As shown in FIG. 8, the building columns 10 include a series of plumbing and gaslines which are adapted to convey a gas used in the conduct of testing services for clinical laboratory such as argon, nitrogen, hydrogen, helium, pressurized air, vacuum, carbon dioxide, nitrous oxide or the like. Each of these gas lines 14 is available in the regularly spaced columns of the laboratory building structure. Similarly, the grid of ceiling service lines also includes plumbing vents 15 which as will be understood are adapted to appropriately vent the sink structures installed in the new work stations as will be described in greater detail hereinafter. The multiple plumbing lines 14 are adapted to supply hot water, cold water, and deionized water as required at the individual work stations.

Figure 4:
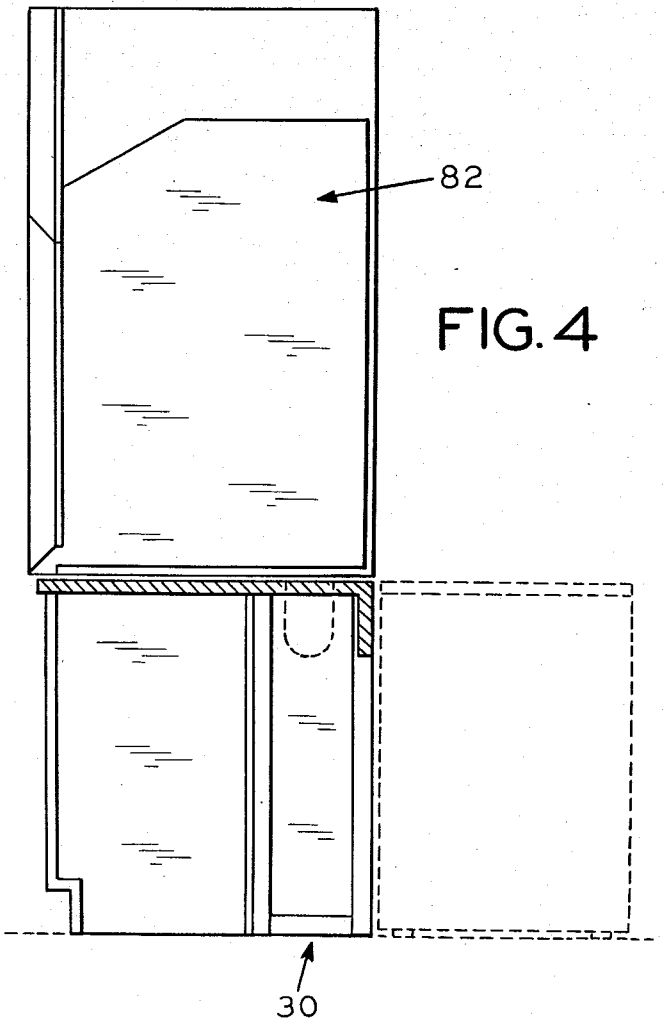
FIG. 4 is a side elevational view of a standard fume hood dimensioned to be integrated into the system of the invention.
Figure 10:
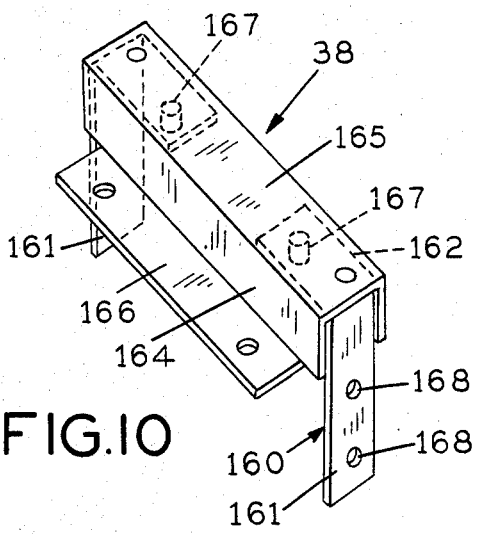
FIG. 10 is a perspective view of a new multi-function bracket used in the assembly of the new laboratory furniture system.

In accordance with the principles of the invention, the various service utilities including electrical cables 16, the aforementioned gas, vacuum, and water lines 14, and the venting facilities 15 are all made accessible to individual work stations wherever required through a utility module unit 30 which in addition to providing support for task lighting and the aforementioned utilities in their horizontal runs from service columns to individual work benches also establishes the fixed and standardized discipline of location for the furniture components and the apparatus making up individual work stations. These components range from standard table structures, sink structures, fume hood structures and the like to customized cabinets and sophisticated work units. As will be appreciated, the specific details of the standard accessory equipment and hardware (connectors, brackets, clamps, etc.) form no part of the present invention and need not be described in any further detail other than to note that all the specialized or otherwise customized lab equipment such as the fume hood shown in FIG. 4, is sized to be integrated directly into the flexible system of the present invention. Unique and specialized hardware or brackets for practicing the invention is illustrated in FIG. 10.

Figure 1:
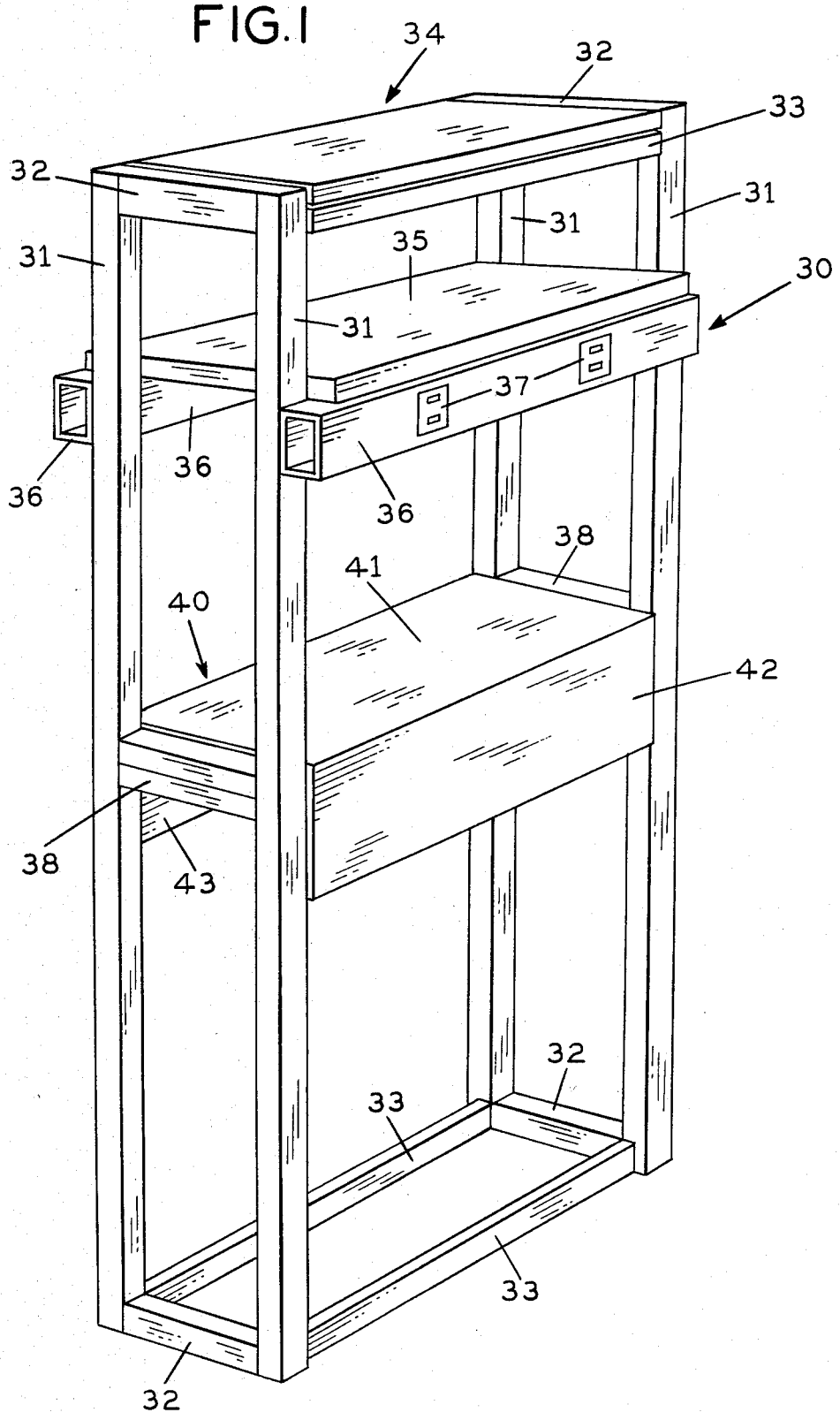
FIG. 1 is a perspective view of the new and improved universal laboratory utility core module of the present invention.

Referring now to FIG. 1, the fundamental element of the new and improved modular laboratory furniture system of the present invention is a utility service module 30. The utility module is advantageously constructed from "Unistrut"-type structural components and hardware such as manufactured and supplied by "Unistrut" Building Systems, Wayne, Mich. and illustrated in detail in numerous U.S. Patents including U.S. Pat. Nos. 3,443,348; 3,468,567, 3,601,347, 3,617,076, 3,618,882, and 3,628,296, among others. The new and improved laboratory utility core module 30 of FIG. 1 is completely free standing and bolted to the floor anywhere in the laboratory space through floor mounts 75. Individual leveling butt plates 74 are included at the bottom surfaces of the lower struts 32 for accommodating slight leveling adjustments. The new and improved utility core module is comprised of two pairs of parallel vertical corner columns 31 which are of pre-determined uniform height, advantageously six feet. The width of the utility core module is four feet and is established by pairs of spaced horizontal beams 33 which interconnect the columns 31 at their top and bottom ends. Pairs of spaced horizontal struts 32 connect the pairs of columns 31 at the tops and bottoms thereof to form a parallelpiped service frame having a depth of one foot. In accordance with the principles of the invention, a top shelf 34 is supported on the upper horizontal beams 33 between the end reinforcing struts 32 and forms a horizontal top wall of the utility core module 30. The utility module core 30 is rigid and self supporting without shelves or intermediate brackets (38, 35, 34, 36).

In accordance with the more specific aspect of the present invention, an intermediate shelf 35 parallel with the top shelf 34 is supported at a selected height between the opposed pairs of vertical columns 31 on special brackets 38. (FIG. 10) A pair of horizontal raceways 36 are fixed to the outer surface of the vertical corner columns 31. The raceways 36 are adapted to conduct electrical service cables, telephone cables, computer cables, and like electrical wiring therethrough. These cables may be tapped to provide exposed electrical outlets 37 at the faces of the raceways and to provide power for instrumentation independent task lighting or the like to be disposed at or proximate to the utility core 30, as well as to provide wiring for lighting fixtures integrated into the module 30.

The special horizontal brackets 38 are disposed parallel to and between the top and bottom struts 32. In accordance with one feature of the invention, the utility modules of the invention have interchangeable tunnels 40 associated therewith which are supported at selected heights by the special brackets 38, in the manner shown in FIG. 1. Details of the brackets 38 are shown in FIG. 10 and are discussed in greater detail hereinafter.

Figure 2:
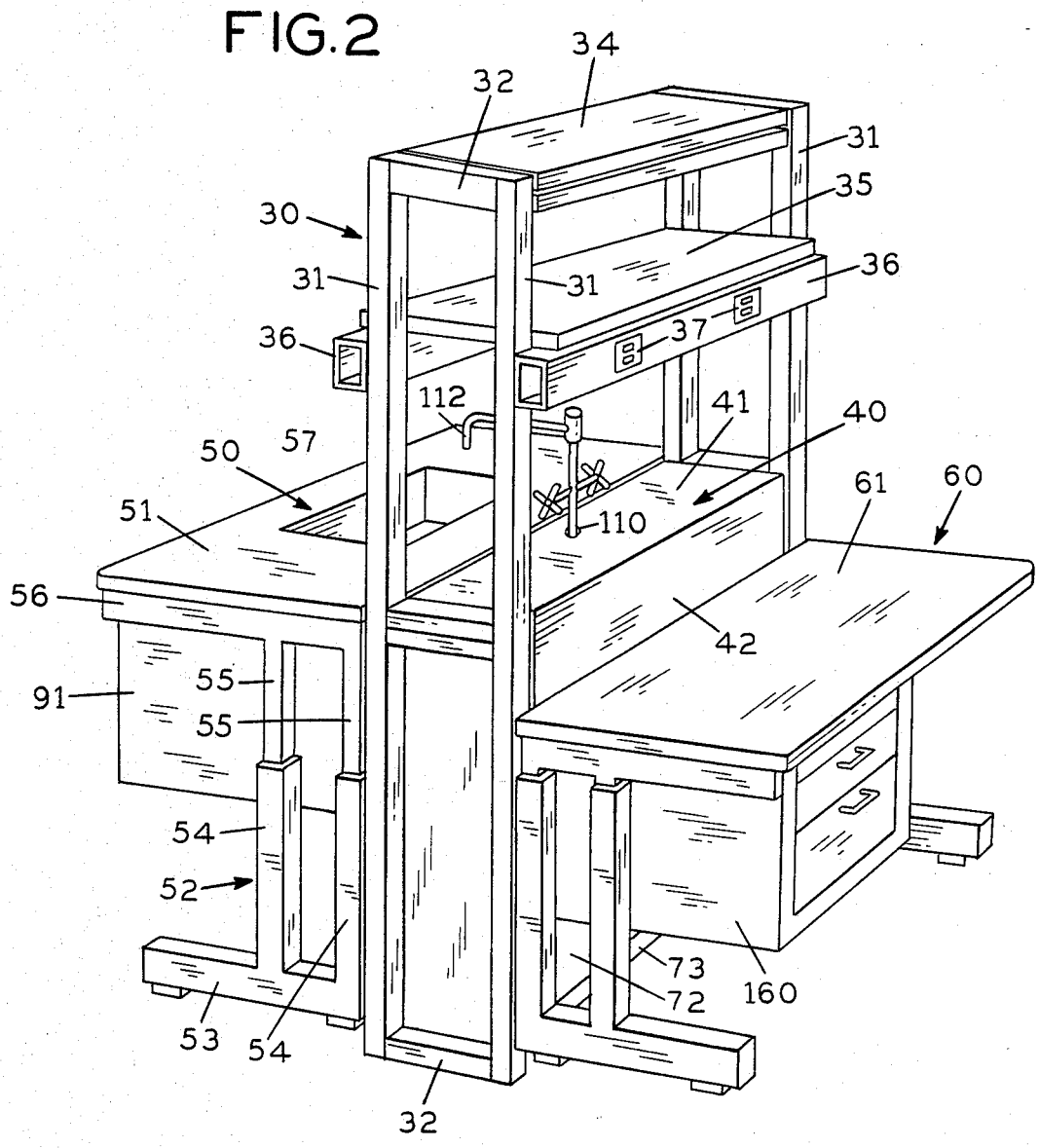
FIG. 2 is a perspective view showing the new utility core module in association with a new adjustable height C-frame sink module and an adjustable height C-frame bench.
Figure 7:
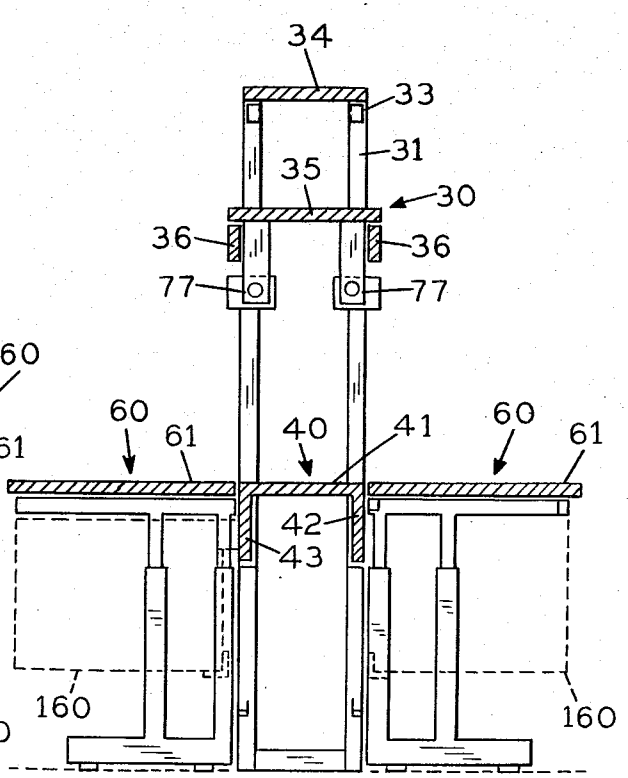
FIGS. 5, 6, and 7 are cross-sectional views of C-frame work tables and sink structures associated with the central utility core modules and associated tunnel structures to provide a variety of work stations configurations at various elevations.
Figure 6:
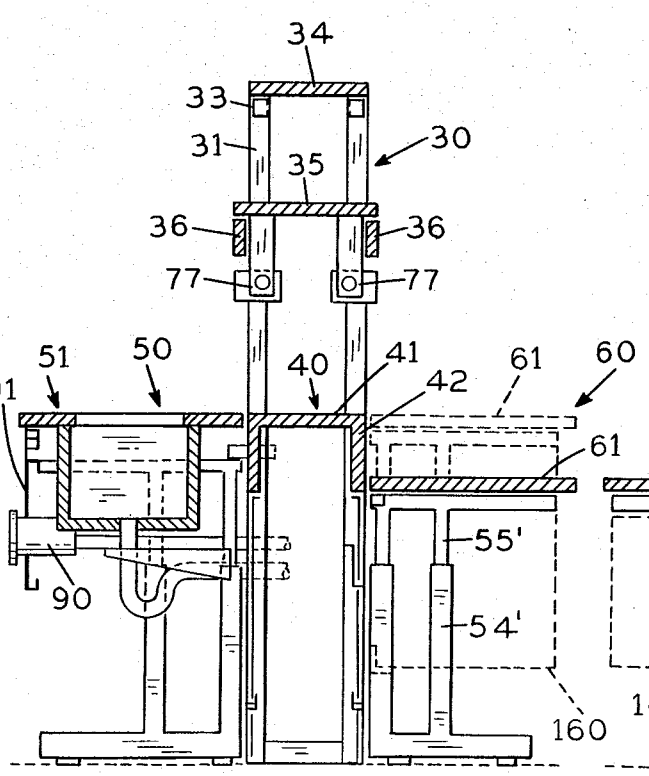
Figure 5:
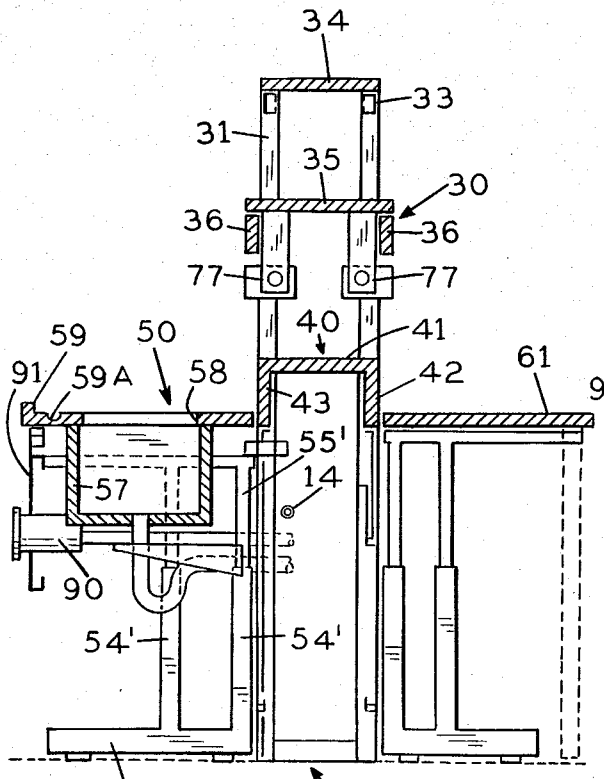

The tunnels 40 are generally of inverted U-shaped cross-section as shown best in FIGS. 5 through 7 and have upper planar shelf portions 41 of full module depth (one foot) and integral depending flange portions 42, 43, which are adapted to be co-planar with the outside front and rear surfaces of the opposed pairs of corner columns 31. In accordance with the principles of the invention, laboratory benches, sinks, and other accessory components having planar work surfaces are adapted to be fastened to the front and/or rear of the utility module with said surfaces co-planar with the tunnel shelf 41 or spaced beneath the tunnel shelf 41 in a manner whereby the flange 42 serves as a bench or sink unit rear wall. Indeed, it is contemplated as shown in FIG. 6 that an accessory sink unit 50 may be mounted with its top surface 51 flush and contiguous with the horizontal upper shelf wall 41 of the tunnel 40, while on the other side of the module 30, an adjustable laboratory bench 60 has its working surface 61 disposed beneath the shelf 41 and abutted against the flange 42 in a manner whereby the flange 42 provides a rear wall for said work surface 61. A perspective view of this arrangement is shown in FIG. 2.

Figure 1A:
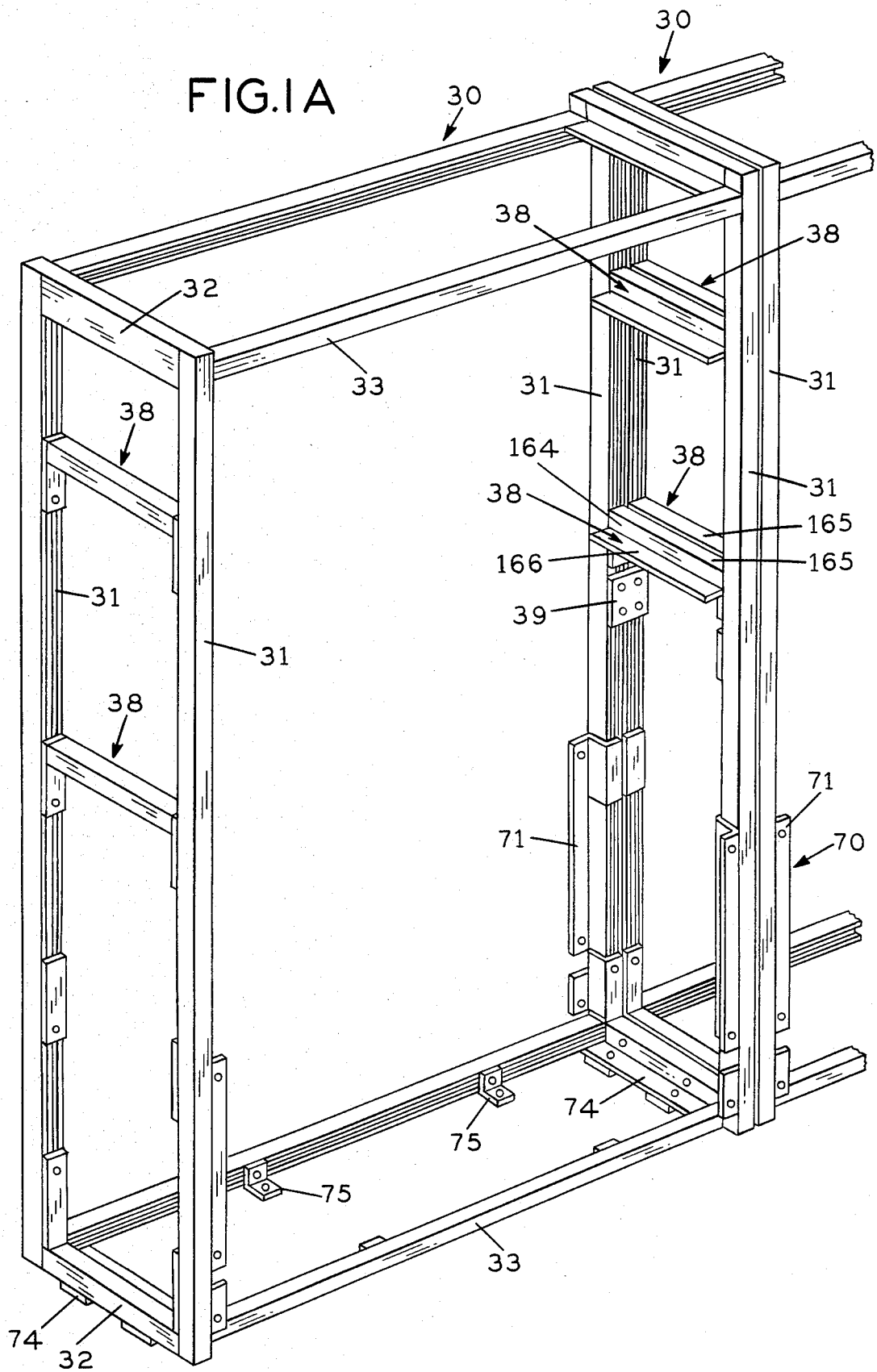
FIG. 1A is a perspective view showing same specific details of construction of the utility core module of FIG. 1.

Referring now to FIG. 1A, the skeletal form of the new and improved utility core module 30 may advantageously be established by light weight structural elements such as, for example, are readily available under the trademark "Unistrut" from the Unistrut Building Systems Division of GTE Products Corporation, Wayne, Mich. While the channels, strips, fittings, and other framing members and hardware employed in the practice of the present invention are advantageously those of the type available from "Unistrut" systems, functionally equivalent mechanical members and hardware from other sources may be employed in lieu thereof. FIG. 1A generally shows the elements described hereinabove but further includes details showing the end to end connection of a pair of utility core modules 30 and further shows hardware for receiving fascia plates at the lowermost portions of said modules to finish off the module structures and to enclose utility services housed therein. To that end, the vertical columns 31 adjacent end to end modules 30 are fastened together by appropriate splicing plates 39, co-planar with the front and rear surfaces of the utility core modules for mounting facsia panels 72 (see FIG. 2). It is to be understood that there are virtually infinite variations and modifications of the fundamental core structures that are available through the employment of "Unistrut" hardware, however, all variations in the establishment of a laboratory work station will be predicated upon the employment of a fundamental utility core module of specific size and shape employing generally the elements described in FIG. 1. In this regard, it is to be understood that the utility core modules are self-supporting and free standing, i.e. in all cases they are bolted directly to the floor by the hardware 75. The modules 30 are adapted to stand against a wall or in an end-to-end series with other utility modules which are either free-standing or wall standing; or the utility core modules, of course, are adapted to be placed against a service column 10.

The brackets 38 are specially constructed to serve several functions, including the end support of center shelves 35; the end support of tunnels 40; the top support of end fascia plates 151; the filling of the gap between the ends of adjacent modules 30; and the mounting of support clamps for vent pipes. As shown in FIG. 10, each bracket 38 is comprised of L-shaped end pieces 160, having vertical legs 161 and horizontal legs 162, which are fastened to a central inverted U-shaped member 163 having a parallel side walls 164, a top wall 165, and a flange 166. A pair of studs 167 are welded to the underside of wall 165. In use, the bracket 38 is fastened through legs 161 between columns 31 by "Unistrut" spring nut hardware passing through holes 168. The precise height of the brackets (and hence the supported shelf or tunnel) may be adjusted to variably position the supporting flange 166 at a desired elevation. The flange 166 supports the underside of top tunnel wall 41 in flush relationship with bracket wall 165. Alternatively, the flange 166 may be employed to support central shelf 35 with its top surface flush with the top wall 165. Thus, potential "gaps" between neighboring center shelves or tunnels, of end-to-end modules 30, will be neatly bridged and completely filled by the top walls 165 of adjacent brackets 38.

In addition to providing end support for tunnels 40 or shelves 35, and bridging or filling the gaps between opposed ends of said tunnels and shelves in contiguous core modules, the bracket studs 167 are adapted to engage the holes 169 in the upper flange 170 of the end fascia plates 151 when such elements are utilized to close off the lower end portions of the module 30. The studs 167 may also be used to mount vent supporting hardware.

Figure 9:
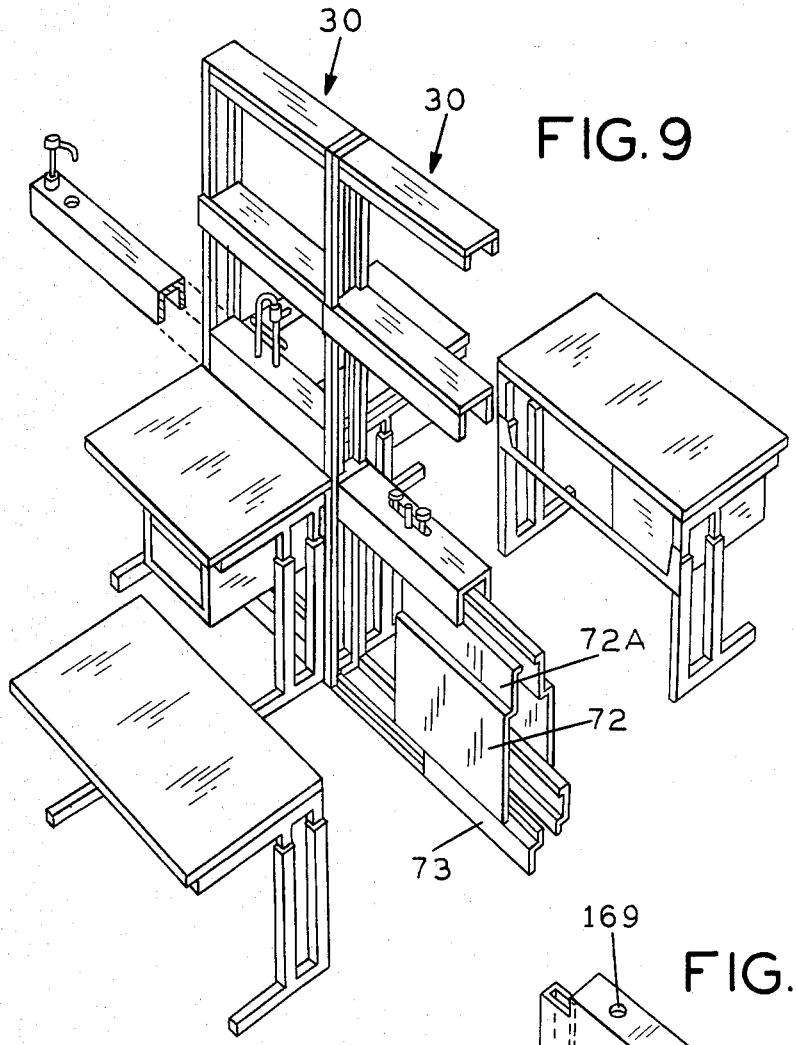
FIG. 9 is an exploded perspective view showing the interrelationship of contiguous utility modules, associated C-frame work tables and fascia and kick plates.

As will be understood, the tunnel height may be adjusted upwardly or downwardly at each work station as required for a particular laboratory application. The lower portions of a module 30, as shown in FIG. 9 may be closed off by a kick plate fascia panel 73 fastened to lower horizontal beams 33, and an associated fascia panel 75 having a recessed upper portion **72*a* adapted to be telescoped by the lower edges of the tunnel walls 42,43 at whatever height the tunnel is mounted as shown in FIG. 9. When greater elevations of the tunnel 40 are desired, an extension fascia panel is added to the panel 75** to increase its effective height.

Figure 2A:
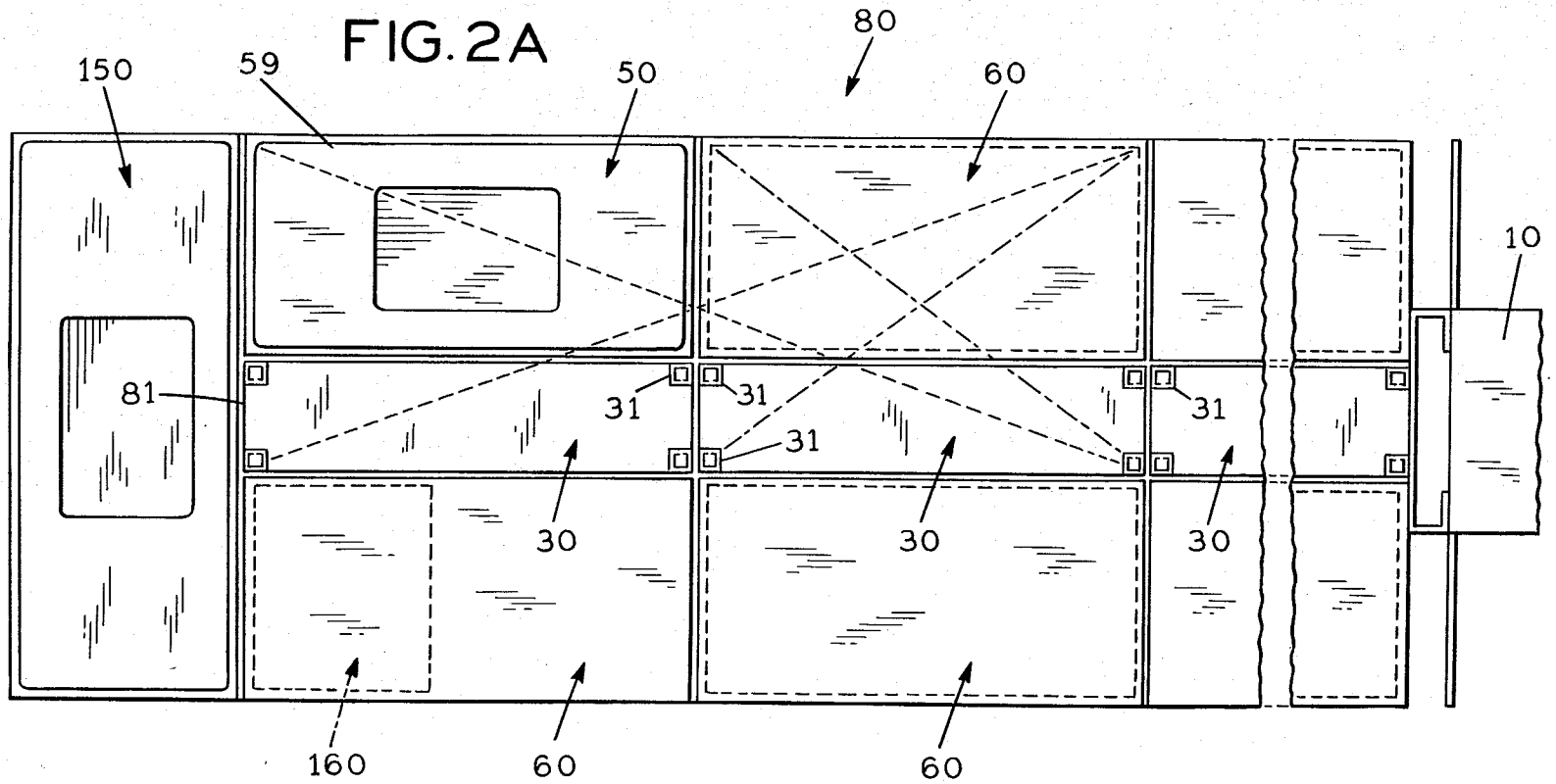
FIG. 2A is a plan view of a work station including a series of utility modules and associated sinks, tables, and the like, selectively arranged into a laboratory work station in accordance with the principles of the invention.

In accordance with the principles of the invention, the utility core modules 30 act as the "spines" of individual laboratory work stations such as the station 80 in FIG. 2A, which is comprised of a series of utility core modules in end to end relation abutting a service column 10 of a laboratory building. The requisite gases, fluids, and electrical connections required to service the work station, which will be comprised of one or more sink structures 50, to be described in greater detail hereinafter, bench structures 60 (and/or other laboratory accessory structures such as, for example, a fume hood 82 shown in cross-section FIG. 4) are conveyed longitudinally through the module 30, as indicated in FIG. 8, in cables 16 and piping 14,15. The vertical "drops" of the piping 14,15 may be anywhere throughout the length of the modules 30 through appropriately formed openings 69 in the tunnels 40 and/or shelves 34,35. At the free end 81 of the series of utility core modules 30, an additional laboratory furniture component such as a special sink having a width of five feet (the total of the depths of the module 30, 50, and 60) 150 may be incorporated. The lengths of the module sink units 50 and/or benches 60 and/or other accessory units are 4 feet, the same as that of the core modules 30, as illustrated in FIG. 2A.

Figure 11:
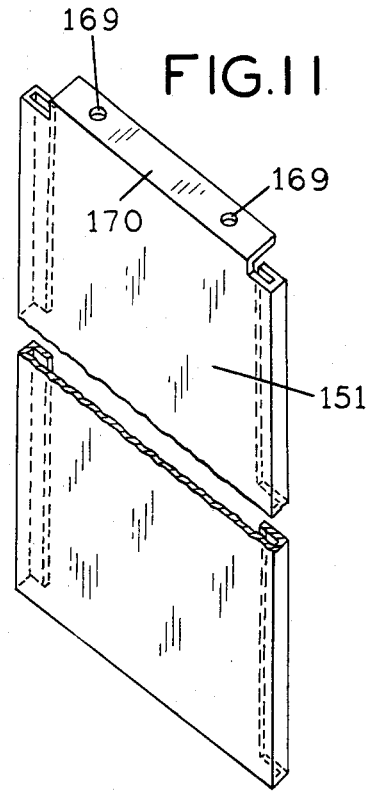
FIG. 11 is a perspective view of the fascia end panel of the new invention.

As an important aspect of the present invention, the utility services required to service the work station 80 and each of the individual components thereof such as sinks, laboratory benches, fume hoods, or the like, may extend in concealed manner from the core service column 10 through the horizontal series of utility core modules 30 to the individual stations. For example, as illustrated in FIG. 8, the gas and/or water lines, may extend through uppermost and/or lowermost portions of the utility module 30 until they are adjacent the work station where they are required. There, the individual gas lines, plumbing lines, electrical lines, or the like, are supported within the utility modules by appropriate hangers and hardware and may be branched directly to a sink or work station as needed. Where the utility lines extend through the lowermost portions of the utility module 30, they will be concealed by the appropriate associated accessory structures such as the hood base or the fascia plates 72 and kick plates 73 (FIG. 9). In addition to the side fascia plates 72 and kick plates 73, end fascia plates 151 (FIG. 11) may be affixed to the outer end of a series of utility modules to close the same off where accessories, or end units 150, such as that shown in FIG. 2A are not employed.

In accordance with the invention, the vent pipes 15 are suspended by brackets 76 from the bracket studs 167 of the multi-function bracket 38, which vent pipes are concealed from view and protected by the depending electrical raceways 36. As a more specific optional aspect of the invention, mounted contiguously with the shelf 35 are flourescent task lighting fixtures 77 designed to intensely illuminate the work stations while being powered directly from an electric receptacle at rear of the raceway 36. Alternatively, equivalent lighting fixtures (flourescent, individual swivel work lamps, or otherwise) may be integrated into the utility module structure in direct association with the shelf 35 and raceway 36 for the purposes of providing intensified local illumination of the work surface and tunnel 40 disposed immediately therebelow. Advantageously, the shelves 35 may have nylon grommets installed therein to receive swivel pins of "Luxo"-type boom-arm task lights, should that type of task lighting be required at a particular station.

As shown in FIG. 8, and in accordance with the invention, the vent line 15 extends from the exterior of the building or the source of venting through the building column 10 through the utility module 30 immediately beneath the shelf 35 and then downwardly to a particular plumbed sink unit 50. The drain of each of the sink units 50 may be connected through drain lines 13 disposed in a regular grid beneath the laboratory floor 11, access to which may be had through drain openings 78 disposed at predetermined intervals in a regular pattern or grid at the surface of the laboratory floor 11.

As will be appreciated, the utility modules 30 while of specific overall shape and size, may be assembled in a wide variety of specific configurations to establish (in association with connected accessory laboratory equipment such as benches, sinks, fume hoods, rolling tables and the like) work stations of numerous different configurations and having work surfaces of varying elevations as required by the equipment employed along the length of the station and having associated shelving of adjusted, compatible heights.

As a further specific aspect of the present invention, new and improved laboratory sinks having infinitely adjustable work surfaces are provided for use in association with the utility core modules 30. As shown in FIG. 2, the new sinks 50 include a "C-frame" support 52 in which the lower horizontal leg 53 has a pair of hollow vertical legs 54 in which a pair of adjustable, locking telescoping legs 55 may be moved upwardly and downwardly to pre-determined levels. An upper horizontal frame 56 of the C-frame 52 supports the sink structure itself which is comprised of a horizontal work surface 51 mounted directly to the upper frame 56 of the C-frame and a sink bowl 57 supported beneath a sink opening 58 in the surface 51. The specific details of each of the individual sink structures may be further customized for specific applications as desired and found necessary. For example, a circumscribing lip 59 may be included or integrally formed at the upper surface 51 to prevent liquids from running off the edge of the table and/or an integral trough 59A may be formed at the surface of the sink to divert or to collect spilled liquids such as mercury, which are often employed in testing procedures. As will be understood, the materials of construction of the sink bowl 57 and sink surface 51 are selected in accordance with the nature of the specific clinical laboratory testing services to be conducted.

Regardless of the specific details of the shape and materials of the sink bowls 57 and the sink work surfaces 51, all of the sinks are adapted to be readily connected to the grid of plumbing and venting through the central utility module 30 in the manner shown in FIG. 8. Specifically, the drain 80 of each sink 50 is connected through an appropriate trap 121 and associated plumbing 122 to the vent line 15 in the central module 30, as well as through drain pipe 83 to the drain 78 and drain lines 13 disposed in the grid 12 beneath the floor of the laboratory.

The C-frame sink 50 is substantially open and accommodates the suspension of a knee actuation member 120 for the plumbing therebeneath. The knee control 90 extends parallel to the upper sink surface 51 from the front of the sink to the rearmost portions where the plumbing supply lines 14 are located in the bottom portions of the central module core 30. As will be appreciated, the new sinks 50 may be varied precisely to any specific height merely by adjusting the degree of telescoping of the support legs 55 within the support tubes 54, as shown for example in FIG. 2. It will be appreciated that the hollow portion of the C-frame may be directly integrated into the upper portion of the sink structure rather than in the bottom portion as shown in FIG. 2. Thus, the versions of the new C-frame adjustable sinks 50 shown in FIGS. 5 and 6 include downwardly opening hollow vertical support tubes 54' supported on base members 53' having vertically extending legs 55. The FIG. 6 embodiment of legs 54' is preferred, since spilled liquid cannot enter the downwardly opening tubular leg 54'. Lockable, adjustable C-frame structures, per se, are, of course, well-known in the art. It is their specific dimensioning and adaption for use as new and improved sink supports in association with the new modules 30 which is important to the practice of the invention.

As indicated in FIGS. 2, 5, and 6, portions of the sink structure immediately below the sink work surface 51 are enclosed by fascia 91 to conceal the plumbing of the sink. The knee actuating member 90 extends from the plumbing itself and passes through the fascia 91. As an important aspect of the invention, the individual work stations may be established having either benches 60 which may be of adjustable height and/or sinks 50 which also may be of adjustable height, which units 50,60 may be interfaced with the center core module 30 in any fashion desired. Thus, as shown in FIG. 2, a sink 50 may be placed in back-to-back relation with a bench 60 through the interposed tunnel 40 with a sink at a high elevation relative to the bench whose work surface 61 is at a lower elevation. Alternatively, as shown in FIG. 6 the bench and the sink may be placed at the same high elevation with the upper sink surface 51 and the upper bench surface shown in phantom in FIG. 6 at the same elevation and contiguous with the upper surface 41 of the tunnel. As shown in FIG. 6, the work surface may be adjusted infinitely by virtue of the telescoping of the legs 54', 55' to any particular height desired within the depth of the front tunnel skirt 42. Where desired, as shown in FIGS. 5, 6, and 7, the tunnel structure itself may be varied within the central utility core module in a manner whereby its upper surface 41 is disposed contiguously with back-to-back benches (and/or sinks) at a low level. Of course, the height of shelf 35 may be varied as desired or found necessary for specific applications. In the FIG. 7 configuration, the skirts 42, 43 will be disposed out of sight beneath the working surfaces 61 of the benches.

Figure 3:
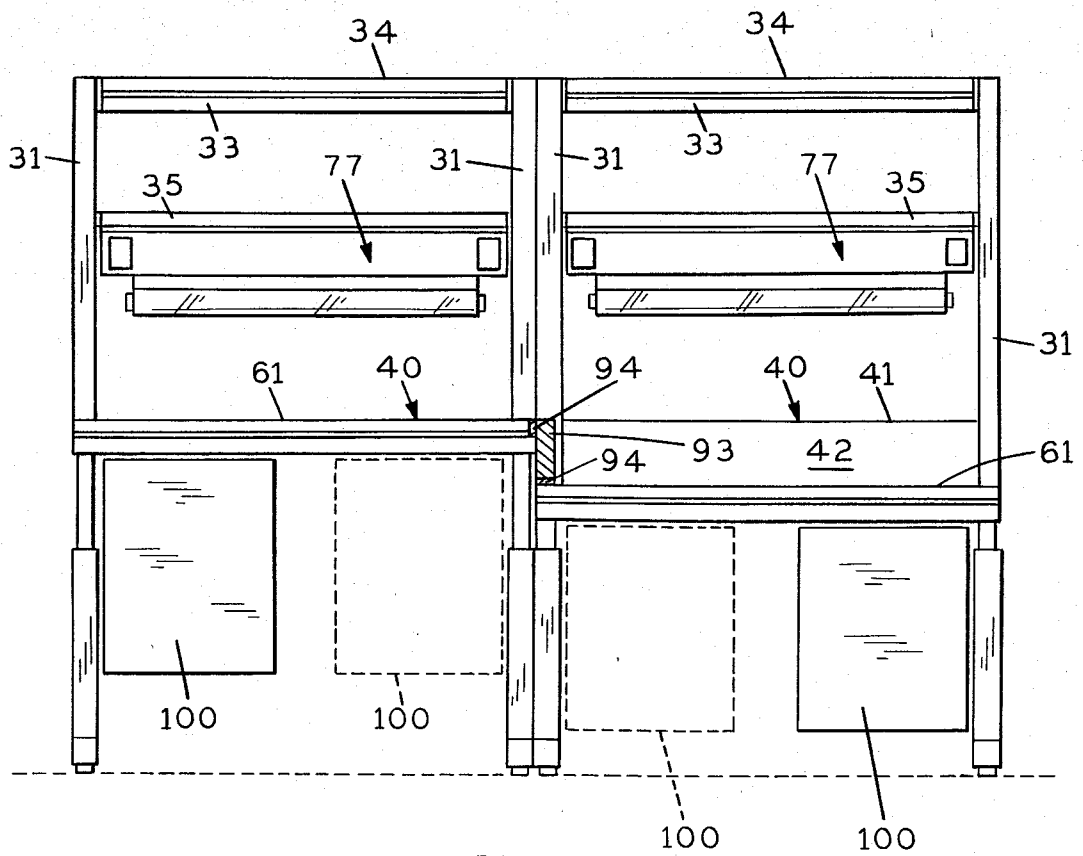
FIG. 3 is a front elevational view of a work station including C-frame tables adjusted at two different heights and associated with the central utility module in accordance with the principles of the invention.

In addition to having infinite adjustment of back-to-back sinks and/or benches integrated into a work station, the new furniture system accommodates the same infinite flexibility with regard to side-by-side utility module cores and associated benches, sinks, and/or other laboratory equipment. As shown in FIG. 3, adjacent benches are disposed at relatively high and relatively low elevations, with the left hand bench having its surface contiguous with the upper surface 41 of the tunnel 40 while the right hand bench is disposed at the bottom of the skirt 42 of the tunnel 40 to provide a lower work surface with the skirt 41 providing a backstop. In accordance with the invention, an elongated sideboard member 93 is fastened in place between the upper surface 61 of the left hand bench and the upper surface 61 of the right hand bench to provide an integrated, attractive side boundary of the particular work place at the right hand bench 61. Sideboard 93 may be fabricated from the same materials, such as a chemical and heat-resistant plastic laminate, used for the manufacture of the tunnels 40, the sink tops 50, and/or the workbench surfaces 61. A watertight joint may be established by use of silicone or a like adhesive sealant 94. An enlarged fragmentary illustration of the installation of the sideboard 93 is shown in FIG. 8A. As shown in FIGS. 3, 6, and 7, appropriate cabinetry 160 may be included beneath the work surfaces 61 in the C-frame benches 60 as required.

As an important aspect of the present invention, the dimensioning of the various key components in the new laboratory furniture system is stabilized and standardized to accommodate the ready interchangeability of accessory structures and the rearrangement of the utility core modules, standardized C-frame sinks and standardized C-frame benches as required to re-establish work stations. In this regard, a typical utility core module has a 6:4:1 ratio. It is 6 feet in height from floor to the top surface of the top shelf 34; it is 4 feet in length from one vertical column 31 to the other, and the width of the central utility module core is one foot. Similarly, the width and length of the sink and bench modules are desirably standardized at 2 feet and 4 feet respectively. Typically a bench joined to a utility core module will have a combined depth of three feet, an ideal depth to accommodate standard 3 foot deep hoods. Such an arrangement is illustrated in FIG. 4 where the bench 60 is shown as a standard fixed height bench rather than an adjustable height, C-frame bench of the type illustrated in FIGS. 6 and 7. The height of the fixed elevation bench shown in FIG. 4 is 3' 1" which is typically the elevation of the bench or sink tops shown in FIGS. 7 and 8. It is noted that the sink shown in FIG. 8 is of the state of the art type having a fixed rather than having an adjustable height such as the new and improved sinks shown in FIGS. 5, 6, and 2.

The tunnel module 40 itself is 1 foot deep and 4 feet long, and its depending flanges are each 6" in height. In accordance with the invention, the selection and integration of the various module components, i.e. the center core module 30, the tunnel module 40, sink modules 50, and bench modules 60 will provide the laboratory work station designer with tremendous flexibility for the establishment of effective, efficient and comfortable work stations anywhere within the laboratory building for the performance of a wide variety of laboratory test procedures. The tunnel structure 40 in combination with the bench surface 61 may be appropriately modified, on a station-to-station basis, to accommodate the passage therethrough and/or mounting thereon of plumbing and gas lines and fixtures. For example, as shown in FIG. 2 opening 110 is formed in the tunnel structure 40 to provide for the installation of a faucet 112. Alternatively, or in addition, the upper surface 41 of the utility module may have small cup sinks formed integrally therewith. A typical cup sink structure 115 is shown formed in the bench surface 61 of the C-frame bench 50 shown in FIG. 8.

It should be appreciated that as an important aspect of the invention, the plumbing for the sink structures 50, the cup sinks 115, and/or any other particular laboratory accessories that are to be disposed adjacent to the central utility core module 30 are for the most part totally concealed in the lower portions of the utility core module as shown in FIG. 8. Moreover, such sinks may be disposed virtually anywhere throughout the laboratory, simply and inexpensive, by extending the plumbing and service lines from the omnipresent service grids to a specific location through the extension of pipes, conduits, cables, and the like through the lengths of the utility core modules from and/or to the ceilings, columns and floors of the laboratory structure. Thus, the utility core module provides a means for accessing laboratory stations disposed anywhere within a laboratory building to the fundamental gas, water, and electrical supplies required while concealing the plumbing, wiring and the like from view, as well as protecting the laboratory workers from accidental or harmful exposure thereto.

As a further specific aspect of the present invention, a new and improved, integrated bench level exhaust module 200 (FIGS. 12 and 13) may be easily installed in the core modules 30 of the present invention. This special ventilation module 200 is formed as a gastight unit from stainless steel and is adapted to be simply supported in the lower portions of a central module 30 in direct physical association with a tunnel 40 and two opposed C-frame laboratory benches.

Figure 13:
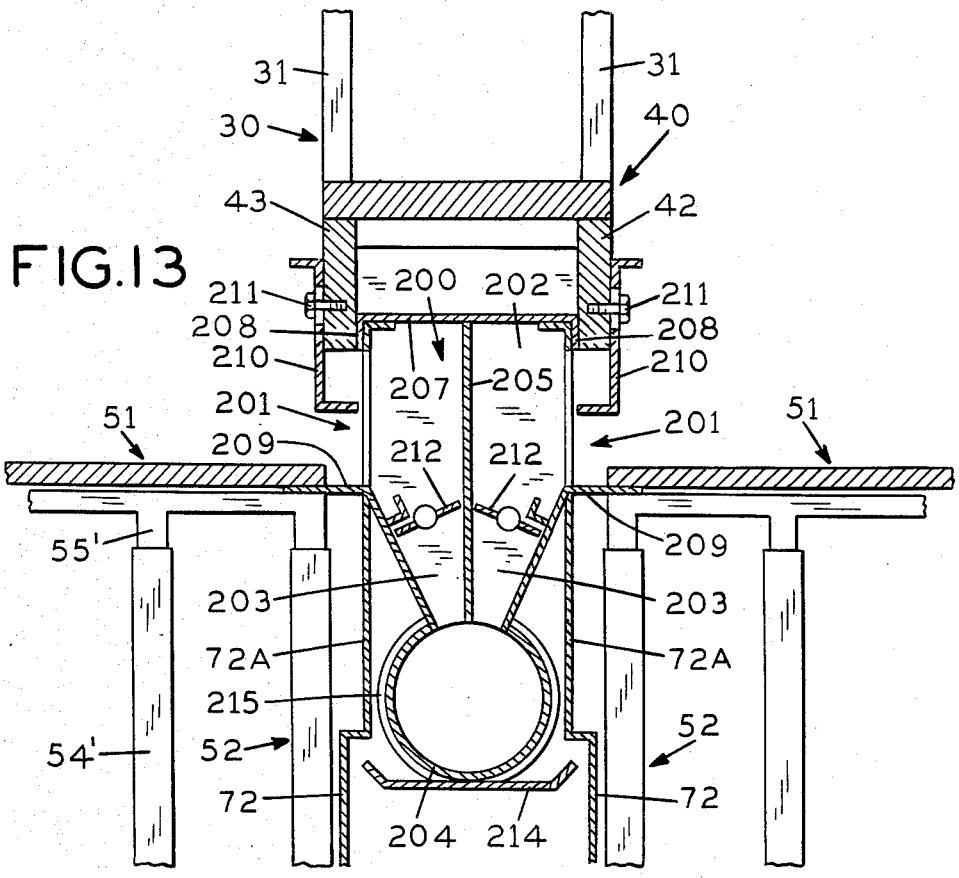
FIG. 13 is a cross-sectional view of the ventilation system of FIG. 12.

Specifically, the ventilation module 200 is adapted to ventilate heavier than air fumes from C-frame table tops 51 through table level air slots 201 extending for almost the full width of the tables. More specifically, the exhaust module 200 includes twin upper plenum chambers 202 which communicate through divided funnel passages 203 to an integral exhaust duct 204 of a circular cross-section, all as shown in FIG. 13. More specifically, the module 200 is divided in half by a central longitudinally extending vertical wall 205, which extends between parallel end walls 206. The module 200 further includes a top wall 207 for the upper plenum chambers 202, which wall 207 has depending flange portions 208.

Figure 12:
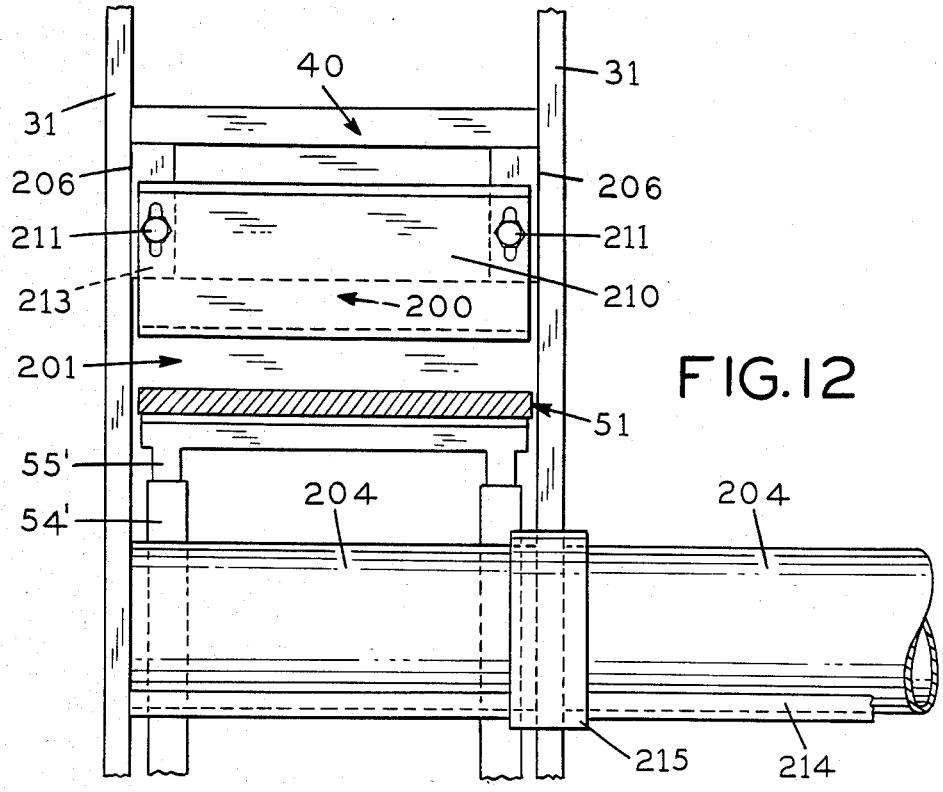
FIG. 12 is a front elevational view of a new bench level ventilating module for heavier than air fumes adapted to be integrated into the new furniture system.

The ventilation module 200 further includes vertical partial front walls 213 as shown in FIG. 12. Bottom support for the module 200 is provided by horizontal support members 214, which are disposed in the utility module 30 between vertical columns 31 thereof.

Integrated into the module 204 are wings 209 extending horizontally outwardly from the top of the funnels 203. The wings 209 are adapted to be clamped between the table top 51 and the C-frame 52 to contribute to the sealing of the exhaust module 200 to table top 51. Thus, the ventilation module 200, is combined in situ with the core module 30, a tunnel 40, and two C-frame laboratory benches to establish a new and improved, bench level exhaust apparatus.

The specific parameters of the openings of the air slot 201 are adjustably controlled for air flow regulations by generally L-shaped baffle plates 210 mounted for a limited vertical movement at the outer faces of the tunnel walls 42,43. The specific height of the air slot 201 may be adjusted by raising and lowering the baffle plates 210 and fixing them in desired positions through locking bolts 211 extending through the baffles 210 from the tunnel 40 as indicated.

Each of the funnel chambers 203 have disposed therein a rough balance air volume damper 212, which is set and located at the time of field installation of the module.

Where a series of ventilation modules 200 are disposed in end-to-end arrayed utility core modules 30, the exhaust ducts 204 of adjacent ventilation modules may be interconnected by banded collars 215 to provide communication between consecutive ducts 204. The endmost duct 204 will be appropriately attached to or otherwise communicated with an exhaust fan of sufficient capacity to maintain a negative pressure in the connected series of exhaust modules 200 and to provide for air flow of approximately 50 cubic feet per minute per linear foot of bench top slots 210. Thus, heavier than air gases present on the table tops 51 will be drawn through the slots 201 the sizes of which are controllably adjusted by the baffles 210, downwardly through the funnel chambers 203 and into the exhaust duct 204 where the gases are drawn outwardly and vented.

The employment of the new utility core module 30, provides for associating a wide variety of laboratory furniture together in a new and improved integrated laboratory station, by virtue of the unique and flexible arrangement of the components of the central utility core as well as the flexibility of certain of the associated laboratory accessories, such as adjustable heights bench modules, adjustable heights sink modules, and the like. It will be appreciated, that the flexible central core module through which the essential utility services are conducted from within the laboratory building skeletal structure, i.e. from within the ceilings, columns, and floors to the individual work stations, will accommodate many preexisting modular components of laboratory equipment such as the fume hood structure 82 shown in FIG. 4. Similarly, standardized rolling benches, rolling cabinets, carts or the like may be wheeled up to and associated with the central core modules. Alternatively, the end module 150 shown in FIG. 2A, may be a specialized free-standing unit such as a computer, or any other piece of laboratory equipment requiring venting, power, plumbing, and/or gas delivered to it.

It should be understood, of course, that the specific forms, arrangements, and variations of the present invention herein illustrated and described are intended to be representative only, as certain changes may be made therein, without departing from the clear teachings of the disclosure. Accordingly, reference should be made to the following claims in determining the full scope of the invention.

We claim:

1. A laboratory work station comprising a plurality of free-standing, universal laboratory utility core modules, each of which is adapted to cooperate laterally with one or more modular, adjustable laboratory bench supports, modular laboratory hood units, and modular laboratory sink units, and longitudinally with the modular laboratory units to provide a fully serviced laboratory work and equipment center, each said utility core module comprising:

(A)

(a) two pairs of spaced parallel vertical corner columns of predetermined modular height;

(b) two pairs of spaced reinforcing struts extending laterally between and connecting uppermost and lowermost portions of said pairs of columns;

(c) two pairs of spaced parallel horizontal beams connecting said two pairs of columns at the tops and bottoms thereof to form a parallelpiped service frame;

(d) rectangular, planar top shelf means supported by the upper horizontal beams and closing off the top of said service frame;

(e) full depth, central rectangular shelf means disposed beneath said top shelf means in a plane parallel to the plane of said top shelf means and supported by said vertical corner columns through first multifunction bracket means;

(f) a tunnel means of inverted-U shape cross-section adjustably supported by said vertical corner columns beneath said central shelf means at a selectable elevation above the lower horizontal beams through second multi-function bracket means;

(g) said tunnel means having a horizontal work surface parallel to said central shelf means and depending integral front and rear walls coplanar with the outside front and rear surface of the pairs of corner columns;

(h) whereby said depending integral front and rear walls are adapted to serve as a bench rear walls and whereby said core module is adapted to cooperate laterally with modular adjustable bench supports, modular laboratory hoods and modular sink units;

(B) said utility core modules are arranged and interconnected in end-to-end relation;

(C) a vent line means extends the length of said station;

(D) hanger means support said vent means immediately beneath said central shelf means;

(E) at least one independently adjustable bench having a planar work surface is abutted to one side of said module; and (F) said bench work surface is disposed beneath the level of said work surface of said tunnel means and against one of said tunnel walls to establish a backstop means for said bench work surface.

2. The station of claim 1, in which (a) at least one sink means is supported by an independently adjustable frame support in direct association with said tunnel means.

3. A free-standing, universal laboratory utility core module adapted to cooperate laterally with one or more modular, adjustable laboratory bench supports, modular laboratory hood units, and modular laboratory sink units, and longitudinally with like modular laboratory units to provide a fully serviced laboratory work and equipment station, said utility core module including:

(a) two pairs of spaced parallel vertical corner columns of predetermined modular height;

(b) two pairs of spaced reinforcing struts extending laterally between and connecting uppermost and lowermost portions of said pairs of columns;

(c) two pairs of spaced parallel horizontal beams connecting said two pairs of columns at the tops and bottoms thereof to form a parallelpiped service frame;

(d) rectangular, planar top shelf means supported by the upper horizontal beams and closing off the top of said service frame;

(e) full depth, central rectangular shelf means disposed beneath said top shelf means in a plane parallel to the plane of said top shelf means and supported by said vertical corner columns through first multifunction bracket means fastened to said vertical corner column;

(f) a tunnel means of inverted-U shaped cross-section adjustably supported by said vertical corner columns beneath said central shelf means at a selectable elevation above the lower horizontal beams through second multi-function bracket means fastened to said vertical corner columns;

(g) said tunnel means having a horizontal work surface parallel to said central shelf means and depending integral front and rear walls coplanar with the outside front and rear surfaces of the pairs of corner columns;

(h) whereby said depending integral front and rear walls are adapted to serve as a rear bench wall and whereby said core module is adapted to cooperate laterally with modular adjustable bench supports, modular laboratory hoods and modular sink units;

(i) an exhaust module for extraction of gases, fumes or vapors heavier than air mounted in said utility core module in direct association with said tunnel means;

(j) said tunnel means forming the upper boundary of an airway entry slot means to said exhaust module;

(k) a table top associated with said tunnel means and forming the lower boundry of said airway entry slot; and (l) a baffle means adjustably mounted on said tunnel means for selectively varying the dimensions of said airway entry slot means.

4. The laboratory station of claim 3, in which (a) said ventilation module includes outwardly projecting wing means disposed immediately below said slot means;

(b) said wing means is sandwiched between an adjacent laboratory bench table top and a support means for said table top.

5. The laboratory station of claim 3, in which (a) said module is divided into twin chamber means by a vertical central wall means.

6. The laboratory station of claim 5, in which (a) control damper means are disposed in each of said chamber means.

7. The laboratory station of claim 4, in which (a) an exhaust duct means of generally circular cross-section forms the bottommost portion of said ventilation module;

(b) said exhaust duct means is adapted to communicate with a source of negative pressure.

8. The laboratory station of claim 7, in which said chambers include (a) a funnel means extending from said slot means to said exhaust duct means;

(b) said damper means is housed in said funnel means.

* * * * *